US007275704B2

(12) United States Patent
Araki

(10) Patent No.: US 7,275,704 B2
(45) Date of Patent: Oct. 2, 2007

(54) COMPOUND DISPERSING METHOD AND APPARATUS

(75) Inventor: Yoshitaka Araki, Tokyo (JP)

(73) Assignee: Araki Iron Works Co., Ltd., Kasukabe-Shi, Saitama (JP)

( * ) Notice: Subject to any disclaimer, the term of this patent is extended or adjusted under 35 U.S.C. 154(b) by 83 days.

(21) Appl. No.: 10/788,535

(22) Filed: Feb. 26, 2004

(65) Prior Publication Data

US 2004/0251337 A1 Dec. 16, 2004

(30) Foreign Application Priority Data

Feb. 27, 2003 (JP) ..... 2003-052003

(51) Int. Cl.
*B02C 17/00* (2006.01)
*B01F 7/00* (2006.01)

(52) U.S. Cl. ..... 241/172; 366/299

(58) Field of Classification Search ..... 241/172, 241/166, 21; 366/299
See application file for complete search history.

(56) References Cited

U.S. PATENT DOCUMENTS 5,346,147 A * 9/1994 Ishikawa et al. ..... 241/172
5,447,372 A 9/1995 Araki
5,497,948 A * 3/1996 Hockmeyer ..... 241/46.17
5,611,619 A * 3/1997 Shen ..... 366/296
6,029,915 A * 2/2000 Inoue ..... 241/17
6,565,024 B2 * 5/2003 Getzmann et al. ..... 241/171
2003/0008946 A1 * 1/2003 Dairoku et al. ..... 523/201

FOREIGN PATENT DOCUMENTS

JP 2000-350930 12/2000
JP 2001-120976 5/2001

* cited by examiner

*Primary Examiner*—Faye Francis
(74) *Attorney, Agent, or Firm*—Donn K. Harms

(57) ABSTRACT

To provide a dispersing apparatus that can stir media in a vessel uniformly, and by increasing the shearing power at stirring, can perform quality constant dispersion with high dispersing efficiency. In a dispersing apparatus wherein a basket-shaped vessel 2 containing dispersing medium consisting of ceramic balls, zirconia balls, and the like is submerged in a tank 8 filled with a compound, and stirrer vanes 28 are rotated in the above vessel to stir the above dispersing medium, and the compound that goes through the inside of the above vessel 2 is dispersed, a rotation driving mechanism 11 for rotating the above vessel 2 in the opposite direction to the above stirrer components.

11 Claims, 8 Drawing Sheets

COMPOUND DISPERSING METHOD AND APPARATUS

BACKGROUND OF THE INVENTION

1. Field of the Invention

The present invention relates to a dispersing apparatus for stirring and dispersing a liquid compound or semi-liquid compound with dispersing media (hereinafter referred to as "media") such as zirconium balls, glass beads, ceramic beads, steel balls and the like, and more particularly, to a dispersing apparatus for dispersing that blend through the shear force generated by passing the compound as a dispersing target through a vessel that is a basket-shaped container wherein the above media are charged and stirred.

In the present specification, a "compound" means a mixture of two or more kinds of materials, and "dispersing" includes stirring or mixing.

2. Description of the Prior Art

In the manufacture of compositions containing solid materials, for example, dispersion of these solid materials into elemental substances of respective particles is performed in the manufacture of paints, inks, and medicines, and the other manufacturing fields of various goods.

For example, the manufacturing of a composition containing solid materials such as paint, ink and the like is made through a premixing process for mixing resin varnish with pigments and obtaining paste. A dispersing process for dispersing the paste obtained in the above premixing process involves the use of a dispersing apparatus, whereby obtaining mill base pigments are dispersed uniformly in the resin varnish, and a dissolution process wherein the mill base obtained in the above dispersing process is mixed and dissolved with solvent, resin varnish and additives as needed by use of a dissolver or the like.

In the case when secondary particles formed by condensing elemental substances of non-dispersed particles such as pigments or the like are formed in manufactured paint or so, the application surface to be obtained by application of such a paint becomes rough and unattractive. Accordingly, the dispersing process in the above process is performed in order to disperse the secondary particles of pigment particles remaining in the paste obtained in the premixing process into the elemental substance particles at nano level.

In such a dispersing process, in order to carry out dispersion more efficiently, a sand grind mill is used as a dispersing apparatus using media, that can continuously disperse the paste obtained from the premixing process.

This sand grind mill, as shown in FIG. 7, is equipped with a vertical vessel 2 wherein for example glass beads with a diameter of about 1 to 2 mm as media are charged, and a shaft 3 that rotates in the vessel 2, and the above stirrer shaft 3 is provided with discus-shaped disks 50 protruding in the outer peripheral direction of the stirrer shaft at specified intervals.

At the lower end of the above vessel 2 a guide inlet 24 is provided for guiding the paste obtained in the premixing process into the vessel 2, while at the upper portion of the vessel 2 a discharge outlet 25 is provided for discharging mill base whose dispersion is completed, and is further provided with a separation means 26 reborn by a screen or the like for separating media from the mill base discharged from this discharge outlet 25.

Further, in the sand grind mill shown in FIG. 7, the outer circumference of the vessel 2 is surrounded with a jacket 5 via specified space, and a flow route 51 of a cooling medium is formed in the space formed between the outer wall surface of the vessel 2 and the inner wall surface of the jacket 5, and a cooling media such as cool water or is guided into the flow route 51, whereby the heat produced at the moment of dispersion can be cooled by heat exchange with the above cooling medium.

In the sand grind mill comprised as mentioned above, when the stirrer shaft 3 is rotated in the vessel 2, media are stirred at high speed in the vessel 2 by the rotation action of the disk 50 being provided with the stirrer shaft 3, and the paste guided from the guide inlet 24 is dispersed by the shearing power of the above media.

The mill base obtained by dispersion of the paste as mentioned above moves upward in the inside of the vessel 2, and is discharged from discharge outlet 25, after media is separated through a screen 26, and is sent to following processes such as a melting process and so on.

Further, as an improved type of the above sand grind mill, there is a sand grind mill provided with the vessel horizontal, wherein pin-shaped projections are being provided with the disk surface so as to enhance throughput. (Refer to Japanese Patent KOKAI (LOPI) No. 2001-120976.)

Moreover, in an example of another dispersing apparatus using media, as shown in FIG. 8, stirrer pins 50' are attached onto the end of a stirrer shaft 3 that is rotated by a driving source such as a motor or the like, and the periphery of the stirrer pins 50' is surrounded by a basket-shaped vessel 2 wherein holes 7 such as small holes or slits are formed on at least the side wall thereof, whereby comprising a dispersing apparatus 1, and media are charged into the vessel 2 of the dispersing apparatus 1, then the media are stirred by rotating the stirrer pins 50' in the vessel 2 when submerged in a compound filling the tank 8. Large particles of the solid materials in the above compound are broken into further finer particles by the shearing power produced by the media stirred in the above vessel 2, and pigment particles that are made into further finer particles flow out from the holes 7 prepared in the side wall or the like of the vessel 2, and are circulated by convection in the tank 8 and flow through guide inlet 24' opened at the top of the vessel 2 into the vessel 2 again, and are dispersed by breaking into still further finer particles. (Refer to U.S. Pat. No. 5,447,372 and Japanese Patent KOKAI (LOPI) No. 2000-350930.)

The dispersing apparatus disclosed in the above 2000-350930 has the benefit that the above dispersing process and dissolution process can be performed simultaneously, and these dispersing apparatuses are used selectively according to applications.

Among the above dispersing apparatuses shown in the prior art, in the dispersing apparatus shown in FIG. 7, namely, in the sand grind mill, it can be used in the dispersing process for dispersing the paste obtained in the premixing process and obtaining a mill base wherein pigments are dispersed uniformly in resin varnish. However, in order to obtain a final product such as a paint from the mill base obtained as mentioned above, it is necessary to go through a dissolution process wherein the mill base obtained in the above dispersing process is mixed and dissolved with a solvent, resin varnish and additives as needed by use of a dissolver or the like.

On the other hand, in the batch-type dispersing apparatus shown in FIG. 8, the paste obtained in the premixing process can be dispersed and dissolved with a solvent, resin varnish, additives and the like, therefore, it has an advantage that the dispersing process by the above sand grind mill, and the dissolution process can be performed in a single process simultaneously. However, because the compound in the tank as the object of the dispersing process is to be guided into the vessel by the convection produced in the tank, the processing time thereof appears to be long in comparison with the sand grind mill wherein a compound is forcibly guided into the vessel by use of a pump or the like.

In such a batch-type dispersing apparatus, if the throughput thereof is to be improved, the rotation speed of pins 50' may be accelerated, but for that purpose, it is necessary to make the driving source such as a motor or the like that rotates the stirrer shaft 3 larger in order to generate a high output. Moreover, it is also necessary to make the transmission mechanism for transmitting driving force, and the stirrer shaft 3, pins 50' stronger in order to operate under the high driving output. Thus, there are limits in improvement for high speed processing.

Moreover, in the batch-type dispersing apparatus, because comparatively large particles in a compound filling the tank 8 tend to collect at the bottom of the tank 8, in order to circulate those particles that tend to collect on the bottom of the tank 8 and to guide them into the vessel 2, it is necessary to provide vanes for flowing fluid 9 for generating a flow of the compound in the tank 8 in the outside of the vessel 2, and also to prepare stirrer shafts, driving sources and the like for rotating these vanes for flowing fluid 9. Therefore, in this kind of dispersing apparatus, the structure thereof becomes comparatively complicated.

Furthermore, in the dispersing apparatus of the above structure, particles in a compound are likely to collect in vessel 2 most likely under the vessel 2 in the tank 8, while in the dispersing apparatus of the structure shown in FIG. 8, the vanes for flowing fluid 9 cannot be provided under the vessel 2, whereby making it difficult to sufficiently stir the contents of the tank 8 under the vessel 2.

In order to solve the above problem, for example, the lower end of the stirrer shaft 3 inserted into the vessel 2 may be expanded downward through the bottom plate 22 of the vessel 2, and the vanes for flowing fluid 9 may be provided on the lower end of the above stirrer shaft. However, in such a structure, with some kinds of media, fragments of media and the like crushed during stirring get in a space or gap between a shaft hole formed in the bottom plate 22 of the vessel 2 and the stirrer shaft 3 whereby being defaced, shortening the service life of the bottom plate 22 of the vessel 2 and the stirrer shaft 3.

Further, in both the sand grind mill in the prior art described above and the batch type apparatus shown in FIG. 8, in the dispersing apparatus wherein dispersing of media is made by the disks 50 provided on the stirrer shaft 3, the plate-shaped disks 50 have small resistance at the moment of contacting media. This is because the power to stir media provided only by the vanes 50' is weak and consequently the shearing power produced by stirring of the media should be weak.

Moreover, although media are comparatively easily stirred around the disks 50, because intervals around 100 mm are generally prepared between each one of the disks 50, the media at the intervals of each one of the above disks 50 are difficult to stir. Therefore, not all the space in the vessel 2 is used effectively for dispersion, and as a result, the dispersing efficiency thereof is not preferable.

As mentioned above, the problems that the sand grind mill has occur in same ways when adopting the same structure in the batch-type dispersing apparatus show in FIG. 8. Moreover, as shown in the above 2001-120976, even if pin-shaped protrusions are provided on the disks, although the stirring property of the media around the portions where the pin-shaped protrusions is improved, it cannot be denied that portions that cannot be used effectively for stirring media in other portions still exist. Therefore, the above problems cannot completely be solved.

On the other hand, apart from the disks 50 mentioned above, in the dispersing apparatus wherein media are stirred by vanes 50' being provided with the stirrer shaft 3, media that collide with the rotating vanes 50' can be flipped off in the rotation outer peripheral direction, whereby media can be stirred.

However, although media can be flipped in this manner by their collision with the vanes 50', the movement direction of the above media is constant in the direction of the circumference, and the shearing power is weak.

Moreover, because the moving speed of the roots (toward the stirrer shaft side) of the vanes 50' is slower than that of the ends (toward the vessel side) of the vanes 50', the shearing power produced at the root portions of the vanes 50' is weaker than that at the end portions thereof.

For this reason, it has the problem that there is unevenness in conditions after dispersion between the compound that is dispersed by passing through the portion around the center of the vessel 2 and the compound that is dispersed by passing through the portion near the wall surface of the vessel 2.

The present invention has been made to solve the above problems in the prior art. Accordingly, an object of the present invention is to provide a batch-type dispersing apparatus wherein a basket-shaped vessel is submerged in a tank filled with a compound, and media charged in the vessel is stirred by stirrer vanes, whereby particles in the compound are dispersed, and the above dispersing apparatus can improve stirring capability without accelerating the rotation speed of the stirrer vanes.

Moreover, another object of the present invention is to provide a dispersing apparatus using the above vessel that prevents particles in the compound from piling up under the vessel in the tank by use of a comparatively simple structure.

Furthermore, still another object of the present invention is to provide a dispersing apparatus that can stir uniformly the media charged in the vessel, and accordingly can use the entire space of the vessel for dispersion, and can have high dispersing efficiency by stirring components thereby increasing the shearing power produced by stirring of media, and accordingly can be made into a smaller size than the dispersing apparatus according to the prior art, and can perform quality constant dispersion with high dispersing efficiency.

SUMMARY OF THE INVENTION

In order to achieve the above objects, a compound dispersing apparatus 1 according to the present invention may be embodied as a compound dispersing apparatus comprising a basket-shaped vessel 2 containing dispersing media 17 that is charged in a tank 8 filled with a compound 19, and stirrer vanes 28 for stirring the above dispersing media contained in the above vessel 2, wherein the stirrer vanes 28 are rotated in the above vessel 2, whereby dispersing the compound in the above tank 8 that goes through the inside of the above vessel 2, and the above dispersing apparatus is characterized by further comprising a rotation driving mechanism 11 for rotating the above stirrer vanes 28 in the above vessel 2, and rotating the above vessel 2 preferably in the direction opposite to the rotation direction of the above stirrer vanes 28 and, the above stirrer vanes 28 may be formed into plate-shaped having a specific length in the axial direction of the above stirrer shaft 3, and on an inner wall surface of the above vessel 2 located in an outer periphery of a formation position of the above stirrer vanes 28, fins 29 having a specific length in the axial direction of the above stirrer shaft 3 may be provided so as to protrude toward the above stirrer shaft 3 with a protruded length not contacting protruding ends of the above fins to those of the above stirrer vanes 28.

In a dispersing apparatus 1 of the above structure, the above rotation driving mechanism 11 may be equipped with a stirrer shaft 3 whose lower end is inserted into the above vessel 2 and secured to the above stirrer vanes 28. A hollow structure adapted to contain the above stirrer shaft 3 internally is provided by a hollow shaft 4 whose lower end is secured to the above vessel 2. Driving sources (motors M1 and M2) rotate the above stirrer shaft 3 and the above hollow shaft 4 in mutually reverse rotation directions.

Furthermore, in a dispersing apparatus 1 of the above structure, vanes for flowing fluid 9 are provided to cause a flow of the compound in the above tank 8, on the outer bottom surface of the above vessel 2.

Further, in the above structure, the space between the protruding ends of the above fin 29 and those of the above stirrer vanes 28 at their closest positions provides a gap 31 which is dimensioned 6 to 15 times as large as a particle diameter of the dispersing media to be charged into the above vessel.

BRIEF DESCRIPTION OF THE DRAWINGS

The object and advantages of the invention will become understood from the following detailed description of preferred embodiments thereof in connection with the accompanying drawings in which like numerals designate like elements, and in which.

DETAILED DESCRIPTION OF THE PREFERRED EMBODIMENTS

Figure 1:
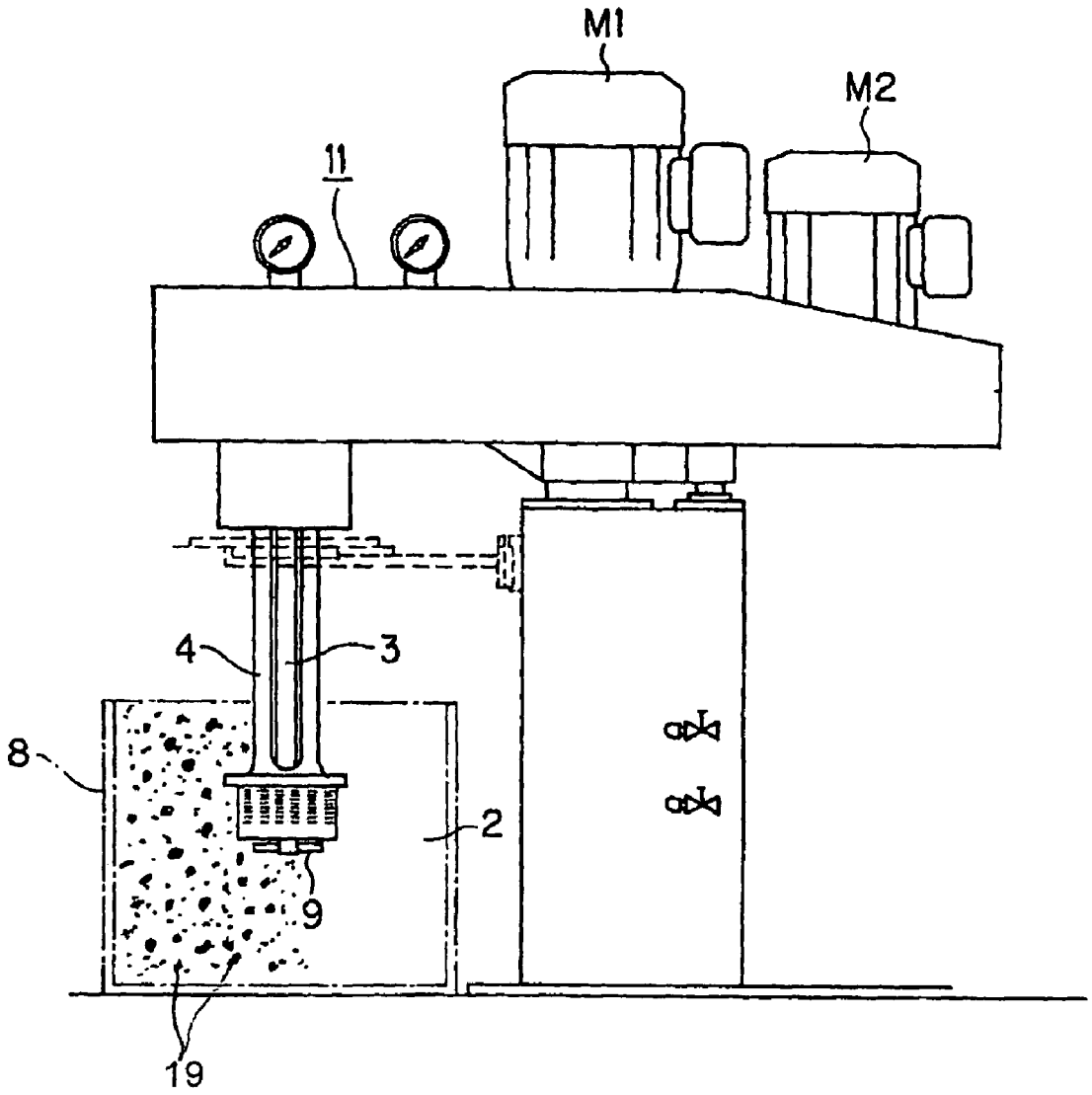
FIG. 1 is a frontal view of a dispersing apparatus showing a preferred embodiment of the present invention.

The present invention is illustrated in more details by reference to the following referential examples and preferred embodiments hereinafter.

A dispersing apparatus according to the present invention is equipped with a vessel 2 that is arranged at the tip of the lower portion of the rotation driving mechanism 11 constituted so as to elevate freely by an elevator mechanism, and is submerged in a tank 8 filled with a compound and can disperse the compound in the tank 8, and media consisting of steel balls, glass balls, ceramic balls, zirconia balls and the like, and stirrer vanes that stir the above media in the above vessel 2.

In this embodiment, the above vessel 2, when submerged in the tank 8 filled with a compound, stirs media contained in the inside thereof, whereby stirring the compound that goes through the inside of the vessel 2, and the upper surface of a cylindrical body 21 that configures the side wall of the above vessel is covered with a top plate 23 wherein an opening is made at the center thereof, and through the opening (guide inlet 24) formed on the top plate 23, the compound in the tank 8 is guided, and holes 7 of many small holes, slits and the like are provided for the compound that goes through dispersing media, and the bottom surface thereof is covered with a solid bottom plate 22 wherein no through hole is provided.

The above cylindrical body 21 in the example illustrated in the figure has a structure wherein plates formed into non-end ring shapes are piled up at a specified interval via spacers or the like, whereby holes 7 of slit shapes are formed between the above plates. The structure of the cylindrical body 21 is not limited to the foregoing means, but a structure wherein wires are provided in parallel at a specified interval, and the above holes 7 are formed by intervals of the above wires may be embodied, or a structure may be formed by use of punching metal wherein many slits and holes of a desired size are formed.

The upper surface of the above cylindrical body 21 is covered with the top plate 23 wherein the opening is provided (guide inlet 24) of a size that allows for the above stirrer shaft 3 to be inserted thereinto, and secures space necessary for guiding a compound in between the stirrer shaft 3, when the stirrer shaft 3 is inserted thereinto. Additionally, the above opening provided on the top plate 23 becomes a guide inlet 24 that guides a compound into the vessel 2.

Then, the compound guided through the above guide inlet 24 is dispersed when it goes through the media stirred in the vessel 2, and this dispersed compound is then discharged via the holes 7 formed in the cylindrical body 21 that configures the side wall of the vessel 2.

Moreover, on the bottom surface of the bottom plate 22 formed solid as mentioned above, vanes for flowing fluid 9 are attached, and when the vessel 2 is rotated, the vanes for flowing fluid 9 rotate together with the vessel 2, making the compound flow under the vessel as mentioned later herein.

Although the above vanes for flowing fluid 9 may be attached to the bottom plate 22 of the vessel 2, for example by welding as a body in the illustrated preferred embodiment, for easy removal for repair or exchange, a screw hole is formed in the bottom surface of the bottom plate 22, and the vanes are fixed with a bolt.

In the inside of the vessel 2, stirrer vanes 28 for stirring media contained in the vessel 2 are provided, and the lower end of the stirrer shaft 3 expanded from the rotation driving mechanism 11 is inserted through the guide inlet 24 formed in the above top plate 23 into the inside of the vessel 2 and the shaft 3 is secured to the above stirrer vanes 28.

Figure 2:
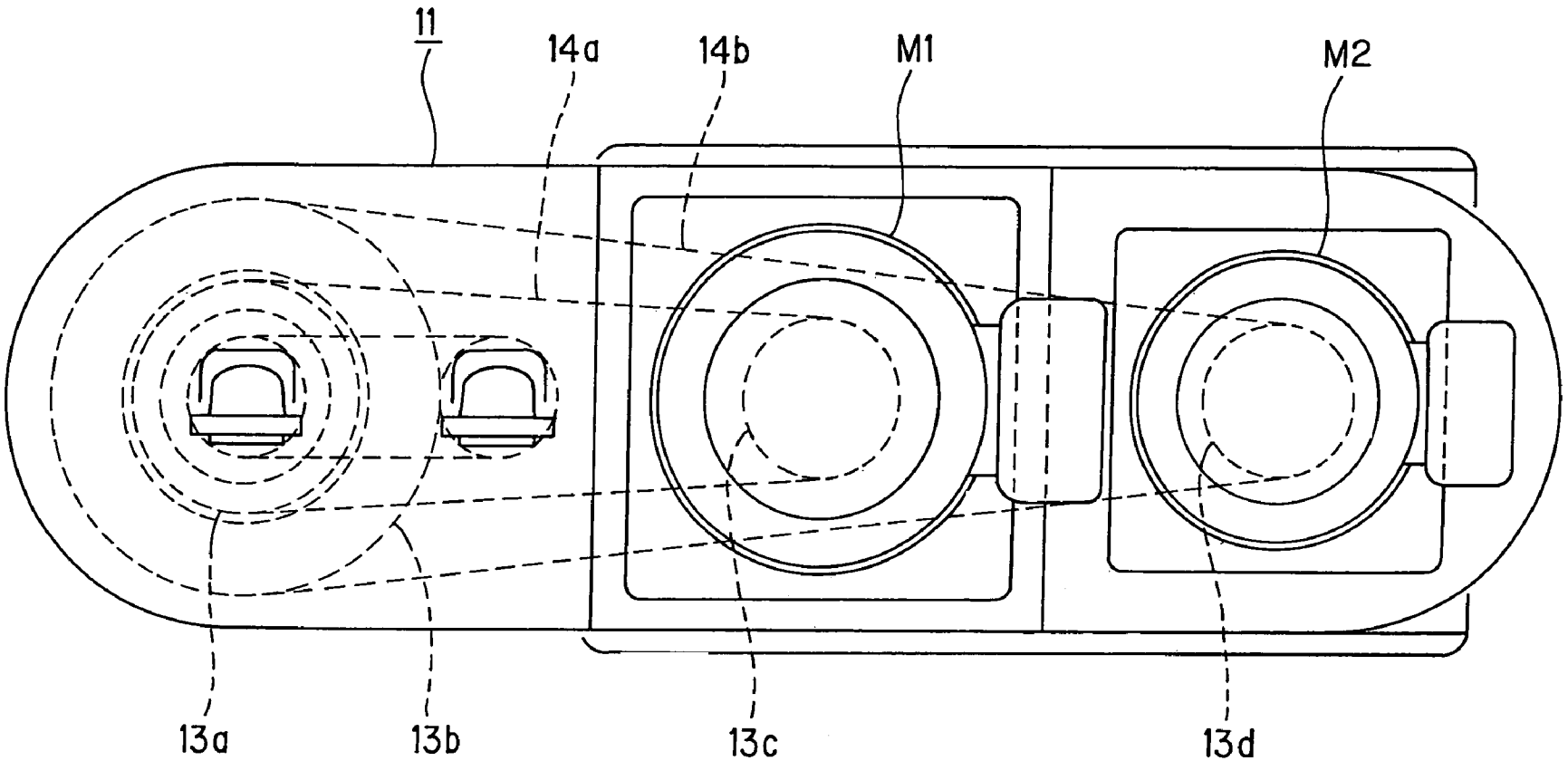
FIG. 2 is a plan view of a dispersing apparatus showing a preferred embodiment of the present invention.

In the above rotation a driving mechanism 11, is provided for rotating the above stirrer vanes 28 arranged in the above vessel 2, and for rotating the above vessel 2 in the direction opposite to the rotation direction of the above stirrer vanes 28. In this preferred embodiment, as shown in FIG. 1 and FIG. 2, the above stirrer shaft 3 for rotating the stirrer vanes 28, and the hollow shaft 4 for rotating the vessel 2 are provided. Further, driving sources such as motors (M1, M2) or the like that generate rotation driving force for rotating the above stirrer shaft 3 and the hollow shaft 4 in mutually normal and reverse rotation directions, and, a transmission mechanism for transmitting the rotation driving force generated in the above driving sources to the above stirrer shaft 3 and the hollow shaft 4 are provided. Other embodiments wherein for example, the above vessel 2 is rotated in the direction opposite to the rotation direction of the above stirrer vanes 28, or as well as the above normal and reverse rotations, the above vessel 2 and the above stirrer vanes 28 are rotated in the same direction, at different rotation speeds shown in a preferred embodiment to be described later herein, may be adopted too.

The lower end of the hollow shaft 4 is secured to the portion near the outer periphery of the top plate 23 of the vessel 2, and at least a part thereof is supported to a bearing provided in a frame or the like of the dispersing apparatus 1 so as to freely rotate therein, and also is connected with the rotation driving mechanism.

Figure 3:
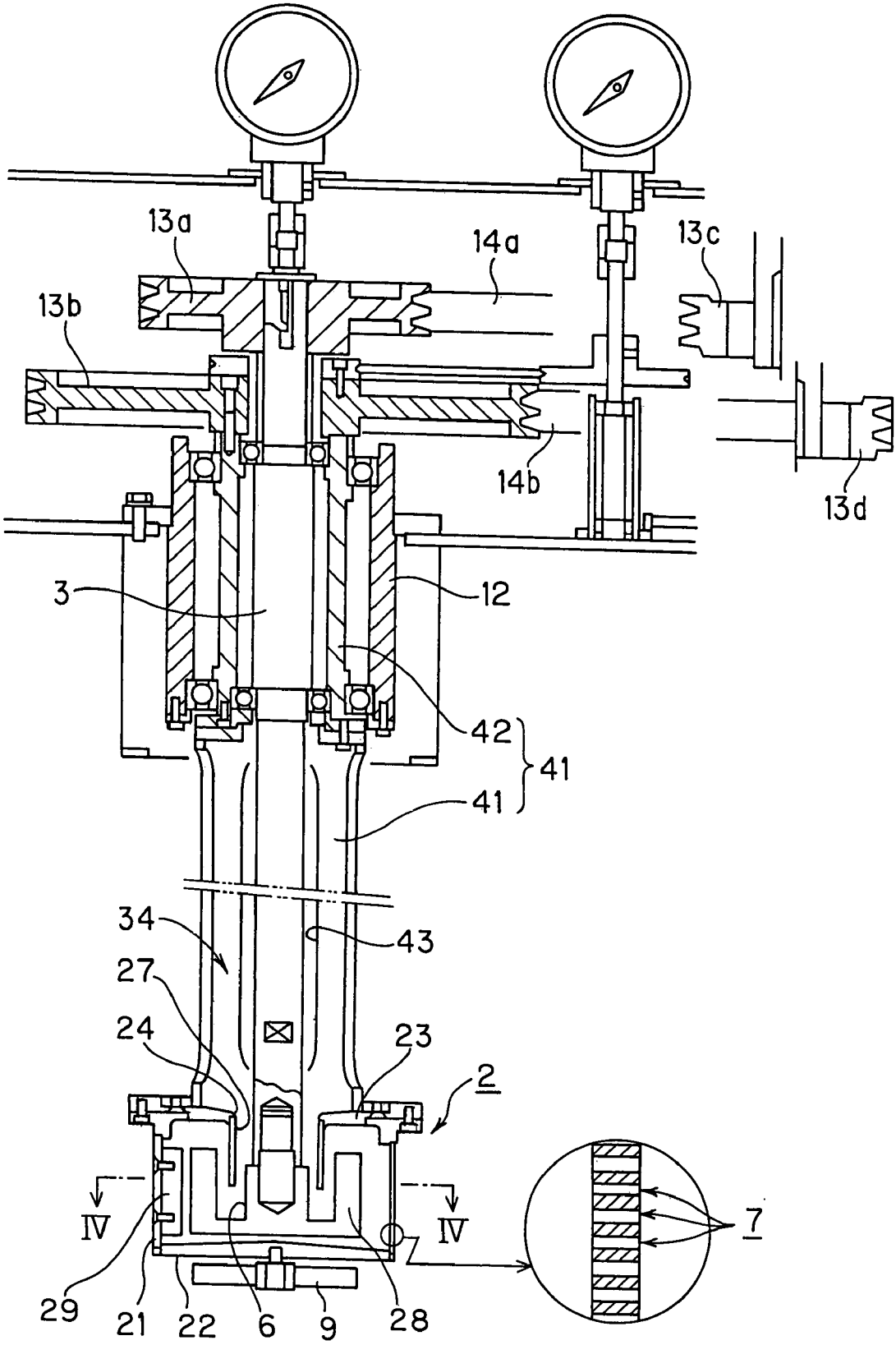
FIG. 3 is an enlarged cross sectional view illustrating major portions of FIG. 1.

In the preferred embodiment shown in FIG. 3, a cylindrical supporting component 12 having an inner diameter large enough for the above hollow shaft 4 to be inserted thereinto is attached to the frame of the dispersing apparatus 1, and a bearing or the like is provided in the above supporting component 12, thereby supporting the upper end portion of the hollow shaft 4 so as to freely rotate therein. And in the illustrated preferred embodiment, the upper end of the hollow shaft 4 from the above supporting component 12, and a pulley 13*b* is attached to the protruding upper end portion of the hollow shaft 4.

The above hollow shaft 4, in the embodiment shown in FIG. 3, comprises a large diameter portion 41 being enlarged from the lower end thereof secured from the top plate 23 of the vessel 2 to around the center of the hollow shaft, and forms specific space to become the flow route of a compound with the outer periphery of the stirrer shaft 3 to be inserted inside thereof as mentioned later herein. A small diameter portion 42 to be inserted into the above supporting component 12, and a bearing or the like is installed in the inside of the above small diameter portion 42, and the stirrer shaft 3 inserted into the hollow shaft 4 is supported in the hollow shaft 4 so as to freely rotate therein.

The stirrer shaft 3, to whose lower end portion the stirrer vanes 28 are attached, is inserted into the hollow shaft 4 as mentioned previously and supported in the inside of the hollow shaft 4 so as to freely rotate therein. A pulley 3*a* and the like for transmitting the rotation driving force from the driving sources such as the above motors are attached from the upper end of the above hollow shaft 4 to the upper end portion of the stirrer shaft 3, and the lower end of the hollow shaft 4 is inserted into the inside of the above vessel 2 and the above stirrer vanes 28 are attached to the lower end of the shaft 4.

The rotation driving sources for the above stirrer shaft 3 and the hollow shaft 4 are motors in this preferred embodiment. While in the preferred embodiment shown in FIG. 3, independent motors are provided, namely, a motor for giving the driving force to the stirrer shaft 3 (stirrer shaft motor M1), and another motor for giving the driving force to the hollow shaft 4 (hollow shaft motor M2).

Meanwhile, the above driving source may be one common motor for driving both the stirrer shaft 3 and the hollow shaft 4. In this case, the force transmitting mechanism for either the stirrer shaft 3 or the hollow shaft 4 must be equipped with a structure for transmitting the rotation driving force from the driving source by converting the rotation driving force into one in reverse rotation.

In the rotation driving mechanism 11 structured as mentioned above, a pulley belt 14*a* is engaged in between a pulley 13*a* on the stirrer shaft 3 and a pulley 13*c* attached onto the output shaft of the stirrer shaft motor M1. A pulley belt 14*b* is engaged in between a pulley 13*b* provided on the hollow shaft 4 and a pulley 13*d* is attached onto the output shaft of the hollow shaft motor M2, then a rotation driving force is input to the stirrer shaft 3 and the hollow shaft 4, thereby rotating the hollow shaft 4 and the stirrer shaft 3 coaxially in reverse directions, so that the vessel 2 and the stirrer vanes 28 are enabled to secure to the lower ends of the respective shafts for rotating in mutually reverse directions.

Although pulleys and pulley belts are used as the above transmission mechanism in the embodiment shown in FIG. 2 and FIG. 3, the above transmission mechanism is not limited to the illustrated structure, and various kinds of other known transmission mechanisms may be employed, such as chains and sprockets, and gear mechanisms.

The lower end portion of the above stirrer shaft 3 communicates into the vessel 2 through the guide inlet 24 formed in the above top plate 23, and, the stirrer vanes 28 for stirring media which are attached onto the lower end portion of the stirrer shaft 3 in the above vessel 2.

Figure 8:
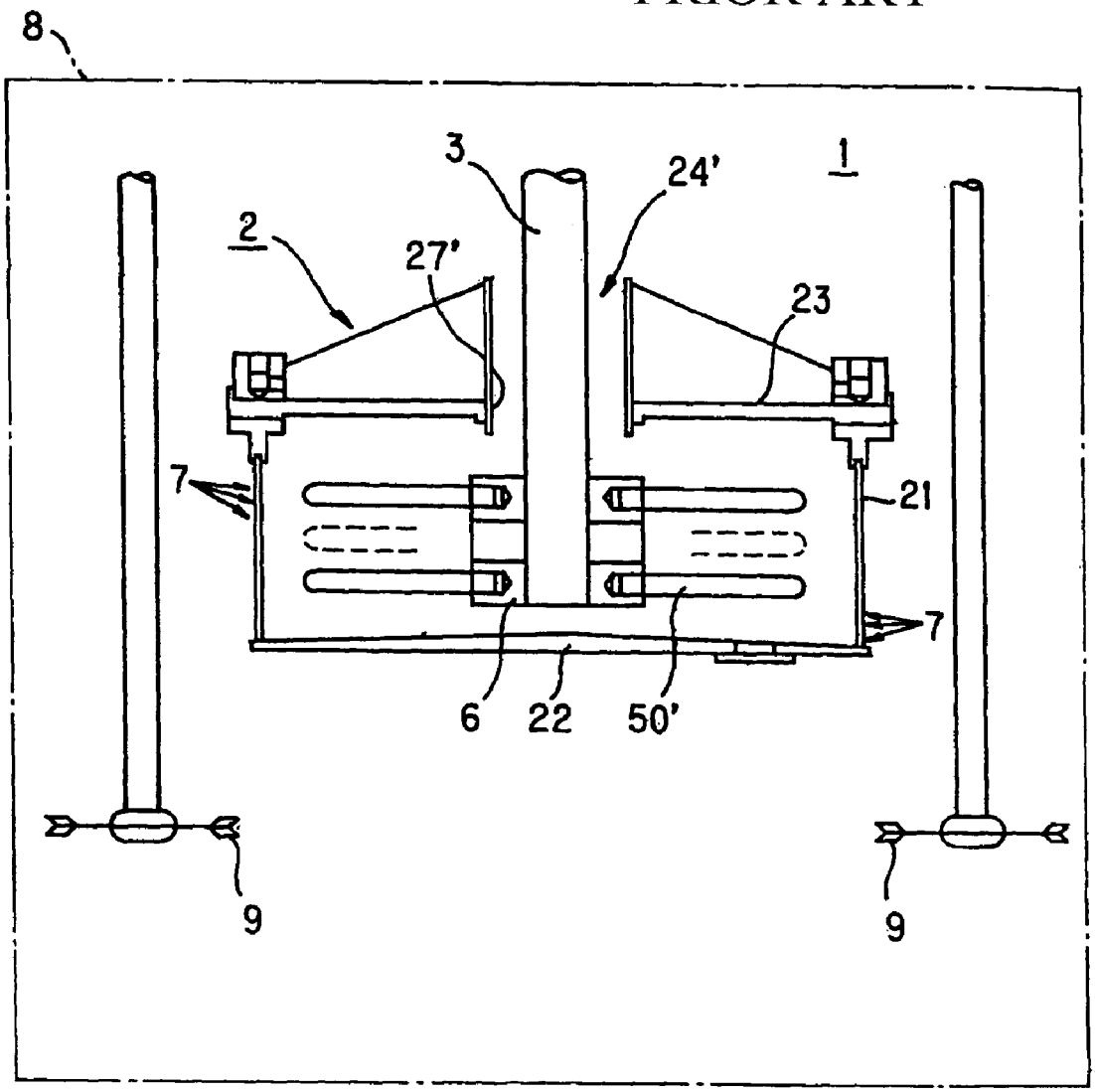
FIG. 8 PRIOR ART
FIG. 8 is a schematic cross sectional view showing another dispersing apparatus according to the prior art.

The above stirrer vanes 28, like in the conventional sand grind mill described in the column of the prior art, may be of disk shape, or pin shape as the stirrer vanes provided in the dispersing apparatus shown in FIG. 8. The dispersing apparatus according to the present invention, employs plate-shaped (paddle-shaped) stirrer vanes whose contact area with media is wide so that stir media in the vessel 2 can be stirred uniformly.

Figure 4:
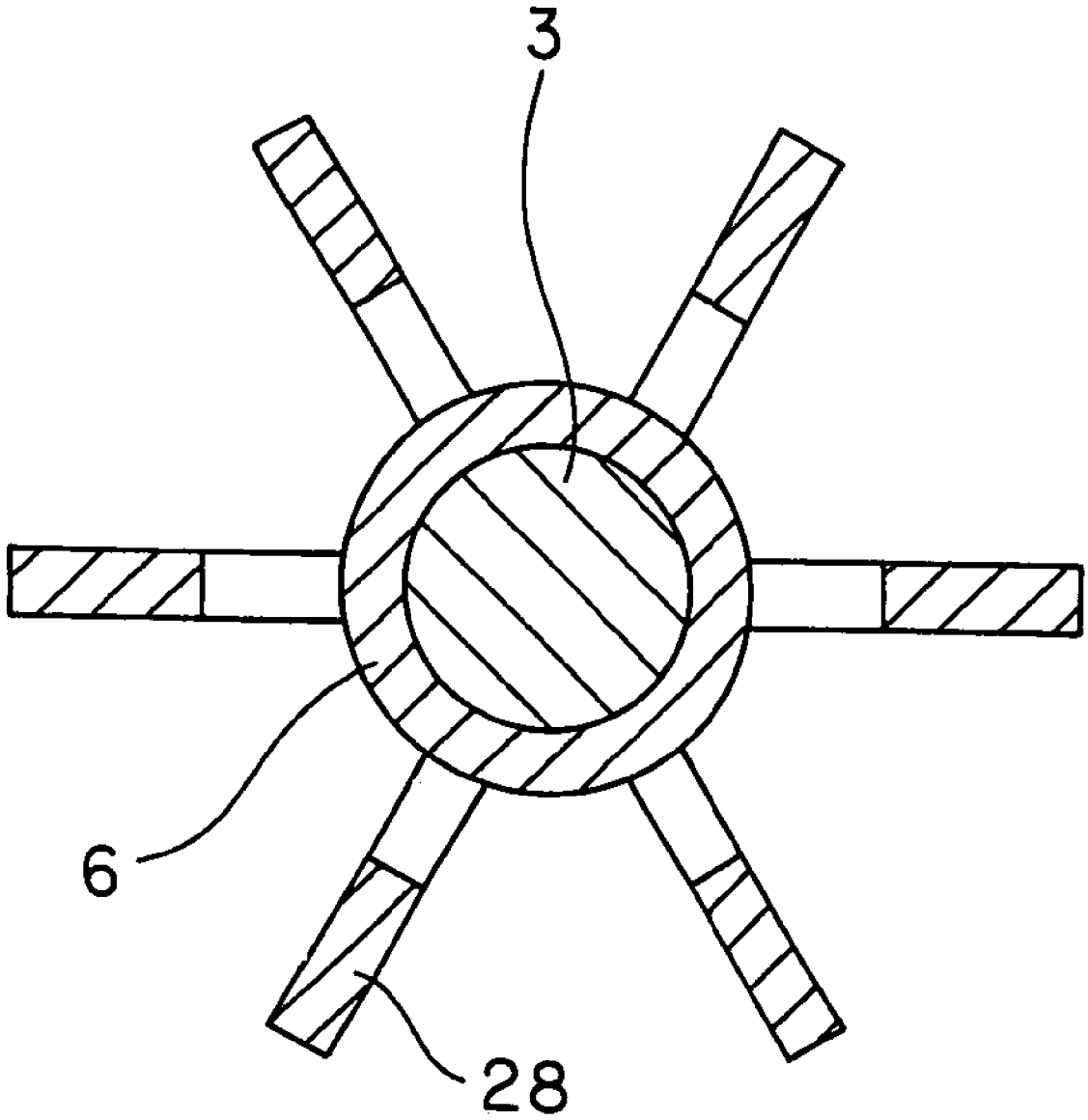
FIG. 4 is a cross sectional view of rotor and stirrer vanes at the line IV-IV in FIG. 3.

In the preferred embodiment shown in FIG. 3 and FIG. 4, a cylindrical rotor 6, and stirrer vanes 28 that protrude from the above rotor 6 toward the outer peripheral direction are formed as a body, and the lower end of the stirrer shaft 3 is secured at the center of the above rotor 6 so that the stirrer vanes 28 rotate in the vessel 2 along with the rotation of the stirrer shaft. So long as the above stirrer vanes 28 can stir media charged in the vessel 2 and preferably disperse a compound, the attachment method to the stirrer shaft 3, the shape of the stirrer vanes 28 and the like are not limited to the preferred embodiment shown in FIG. 3 and FIG. 4, and various modifications may be possible.

In the embodiment shown in FIG. 3 and FIG. 4, the above stirrer vanes 28 are roughly structured into an L shape only whose lower end is secured to the above rotor 6 (refer to FIG. 3.).

In the embodiment shown in FIG. 3 a cylindrical obstructive plate 27 is provided in the manner that the plates 27 expand downward from the inner peripheral portion of the guide inlet 24 formed in the top plate 23 of the vessel 2. The above obstructive plate 27 is provided in the inner periphery of the rotation orbit of the stirrer vanes 28, whereby preventing media charged into the vessel 2 through the guide inlet 24 formed in the top plate 23 from splashing outward. However, it is not always necessary to provide the above obstructive plate 27, and in such a case, there is no need to limit to secure the stirrer vanes 28 to only the lower end of the rotor 6.

Figure 5:
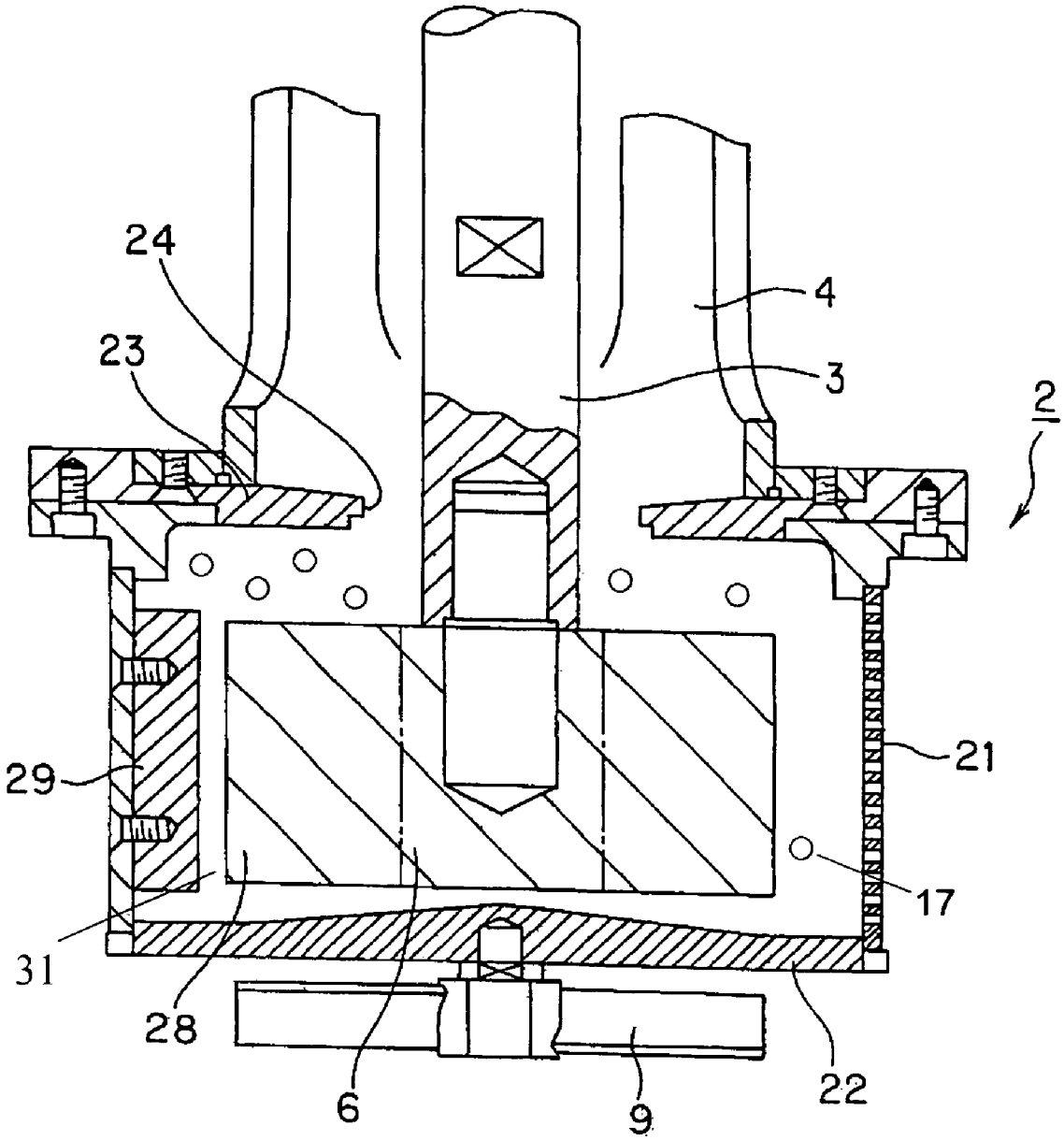
FIG. 5 is a schematic view showing a modified example of stirrer vanes and fins.

Further, as for the attachment of the stirrer vanes 28 to the rotor 6, for example, the stirrer vanes 28 may be formed into rectangular shapes as shown in FIG. 5, and one side of each thereof may protrude from the rotor 6 attached onto the stirrer shaft 3. Although each of the stirrer vanes 28 is formed in one solid shape vertically thereof in the illustrated preferred embodiment described above, the shape thereof may be formed into plural separate pieces, for example, a shape as shown in FIG. 6 (A) and FIG. 6 (B).

Figure 6:
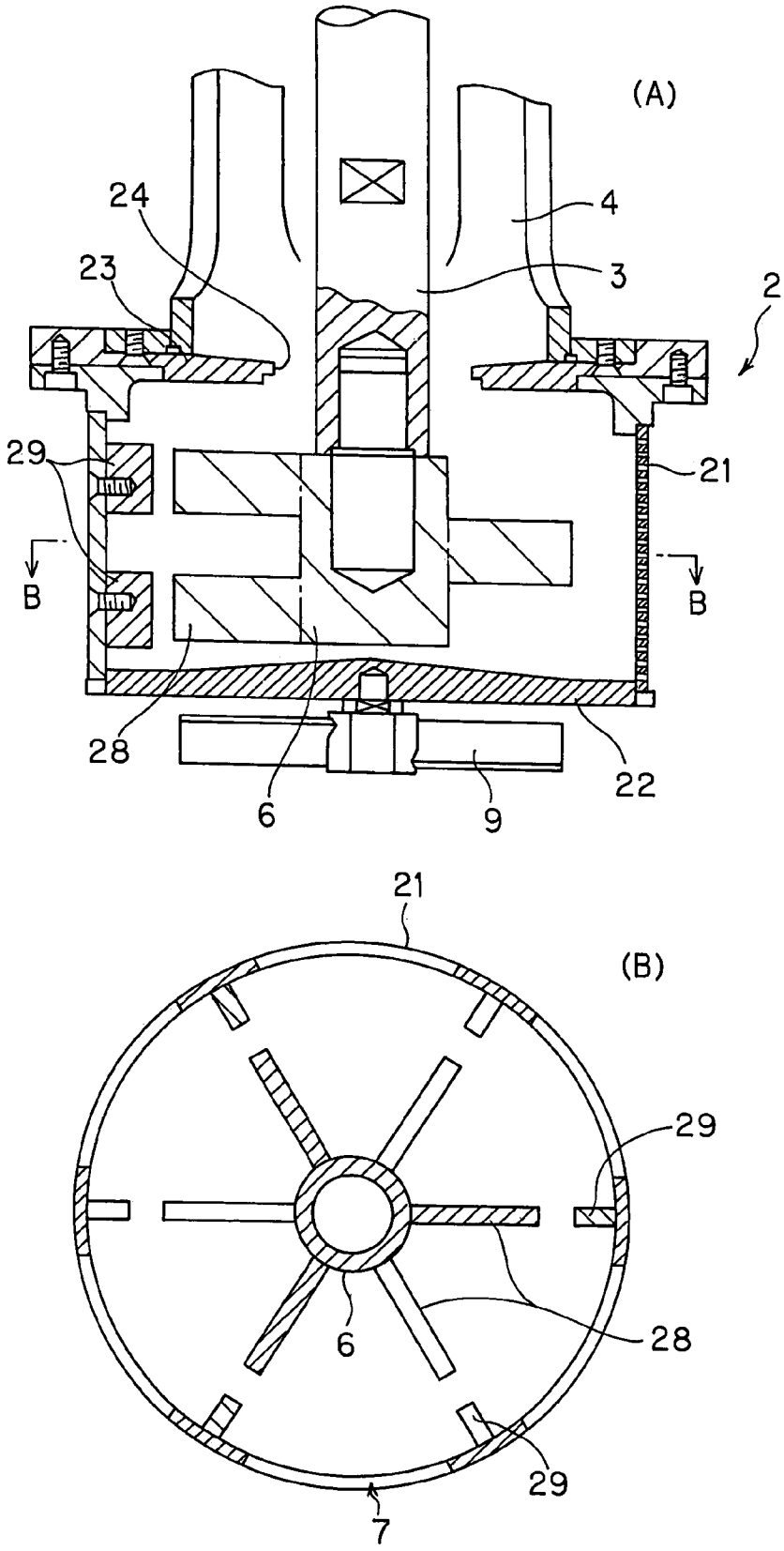
FIG. 6 is a schematic view showing a modified example of stirrer vanes and fins, and FIG. 6 (A) is a frontal cross sectional view, while FIG. 6 (B) is a cross sectional view of (A) at the line B-B.
Figure 7:
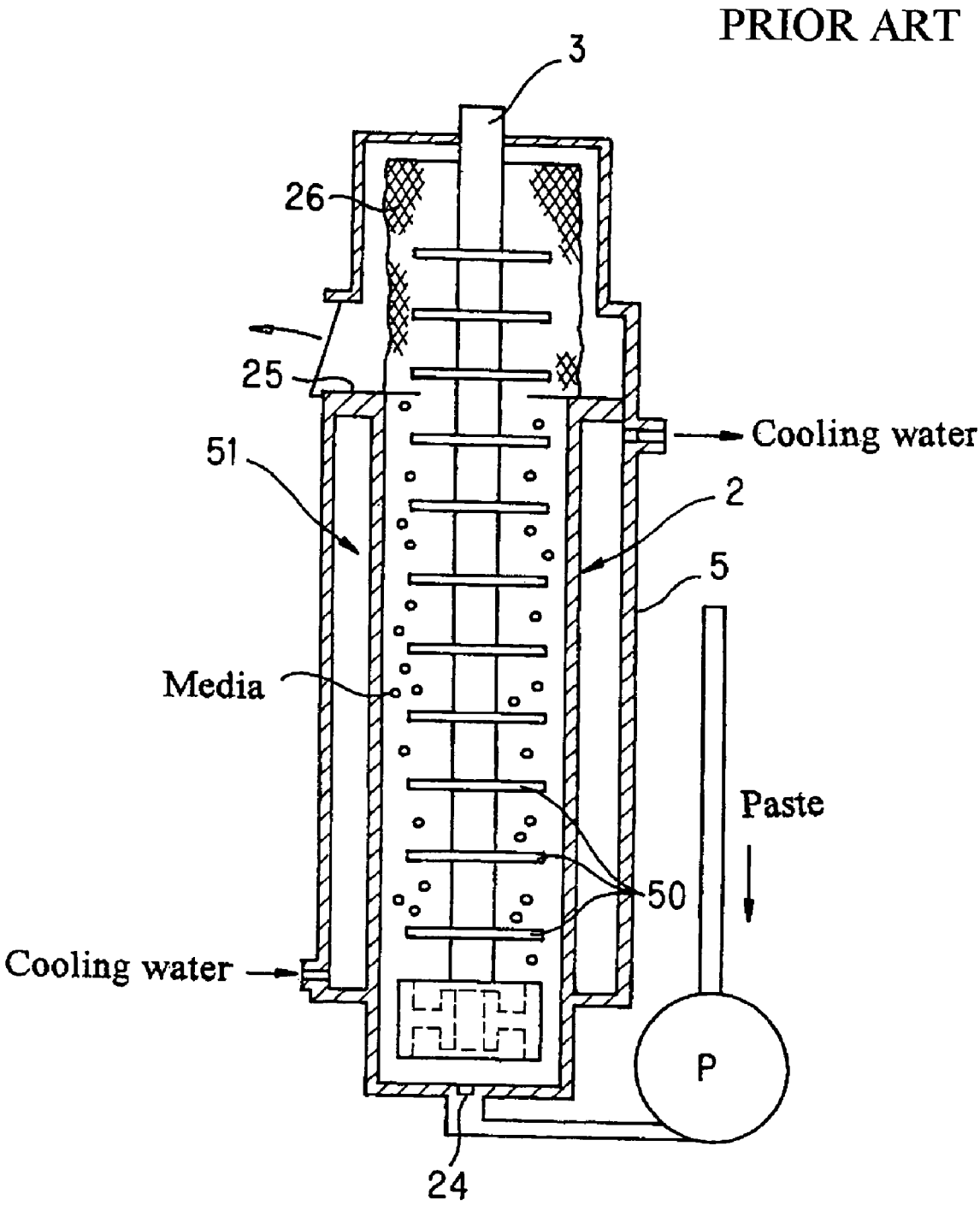
FIG. 7 is a schematic cross sectional view showing a dispersing apparatus according to the prior art.

In the embodiment shown in FIG. 6 (A), the stirrer vanes 28 are vertically separated into 3 stages and stirrer vanes at each stage are provided at the positions that divide the outer periphery of the axis formed by the stirrer shaft 3 at equal angles of 120 degrees. The formation interval between stirrer vanes at one stage and stirrer vanes at other stages adjacent to the above stage in the vertical direction are in phase of ½ cycle in the rotation direction of the stirrer shaft 3.

Therefore, in the example shown in FIG. 6 (A) and FIG. 6 (B), the stirrer vanes 28 formed at each stage protruded in the positions to overlap in a plane view at every other step as shown in FIG. 6 (B).

The above stirrer vanes 28 may be integrated with, for example, the stirrer shaft 3, or the rotor 6 attached to the stirrer shaft 3. Further, in consideration of easy exchangeability in the case of friction or so owing to collision with media by the moment of dispersing work, plates formed separately from the stirrer shaft 3 or the rotor 6 may be attached to the outer periphery thereof as stirrer vanes 28.

In this preferred embodiment, plates made of tungsten carbide that is used in cemented carbide tools and the like which are to be abraded may be attached as stirrer vanes 28 around the outer periphery of the stirrer shaft 3 or the rotor 6.

By forming the stirrer vanes 28 in the shape of planes in this manner, the contact surface thereof with media charged in the vessel 2 is increased in comparison with the disk-shaped or pin-shaped vanes described in the prior art, thereby allowing media to be stirred in a precise manner.

To increase the contact area with the media, the above stirrer vanes 28 are formed with a specific length in the axial direction of the stirrer shaft 3, and plural vanes are provided at positions that divide the outer periphery of the stirrer shaft 3 at equal angles.

Moreover, on the inner wall surface of the vessel 2 located in the outer periphery of the above stirrer vanes 28, fins 29 formed with a specific length in the axial direction of the stirrer shaft 3 are formed so as to protrude toward the inner peripheral direction of the vessel 2 to a position not to contact the above stirrer vanes 28. The movement of media that tend to move when stirred by the rotation of the stirrer vanes is regulated by the above fins 29, movement resistance of media 17 is increased, thereby increasing the shearing power that is generated at the moment of stirring.

The above fins 29 are formed of a specific length in the axial direction of the stirrer shaft 3 so as to generate preferable resistance against media that tend to move when stirred by the rotation of the stirrer vanes 28 as mentioned above. These fins then regulate the movement thereof and increase the shearing power that is generated by the stirring of the stirrer vanes 28. A plurality of vanes are provided at positions that divide the inner periphery of the vessel 2 at equal angles in the peripheral direction thereof.

In the preferred embodiment shown in FIG. 3 and FIG. 4, 6 (six) fins 29 of the same length as the above stirrer vanes 28 along the axis formed by the shaft 3 are provided so as to divide the inner wall surface of the vessel 2 at equal angles of 60 degrees in the peripheral direction thereof.

In addition, as shown in FIG. 6 (A) and FIG. 6 (B), the above fins 29 may be divided into plural fins at regular intervals along the axis formed by shaft 3, and 3 (three) fins are provided at each stage at the positions dividing the inner peripheral surface of the vessel 2 at equal angle of 120 degrees. Fins of vertically adjacent stages may be in phase of ½ cycle in the rotation direction of the stirrer shaft 3.

Therefore, in the example shown in FIG. 6 (A) and FIG. 6 (B), when the fins 29 are positioned on a corresponding stage to the extension line of the stirrer vanes 28 formed on one of the stages, these fins 29 are also positioned corresponding to the extension line of the stirrer vanes 28 on other stages.

Further, in the embodiments shown in FIG. 3 and FIG. 5, the example describes stirrer vanes 28 and fins 29 that are made into a same length in a continuous manner in a height direction along the axis defined by shaft 3. FIG. 6 (A) and FIG. 6 (B), show the stirrer vanes 28 divided in the height direction and the fins 29 divided in the height direction in the same manner. However, a dispersing apparatus according to the present invention may be structured by combining the stirrer vanes 28 formed in one body in the height direction with the fins 29 divided at specific intervals in the height direction, and to the contrary, the stirrer vanes 28 divided in the height direction may be combined with the fins 29 formed a continuous manner in the height direction to structure a dispersing apparatus according to the present invention. Therefore, the combination thereof is not limited to the embodiments illustrated herein.

The above fins 29 may be integrated with the cylindrical body 21 of the vessel 2. Plates made of material with excellent abrasion resistance such as, tungsten carbide or the like, formed separately from the cylindrical body 21 of the vessel 2 are attached to the inner wall surface of the cylindrical body 21 of the vessel 2 by fixing them with a bolt or the like.

The projection length of the above stirrer vanes 28 to the outer peripheral direction from the axis defined by stirrer shaft 3, and the projection length of the fins 29 toward that axis are determined by the mutual relations of the projection length of the above stirrer vanes 28 and the fins 29, and the diameter of media used. Preferably, the projection lengths are so determined, when the protruded ends of the stirrer vanes 28 are at the rotation position closest to the protruded ends of the fins 29, that the gap 31 between the protruded distal ends of the stirrer vanes 28 and those of the fins 29 should be 6 to 15 times the diameter of media.

As an example, in the case of using ceramic beads, glass beads, zirconia balls, steel balls with a diameter of 2 mm as media, the protrusion lengths are determined so that the gap 31 between the fins 29 and the stirrer vanes 28 should become around 20 mm.

When the gap 31 between the above fins 29 and the stirrer vanes 28 is made to be 5 times or below the diameter of media 17, the media tends to be blocked in bridged status in between the fins 29 and the stirrer vanes 28, so all the stirrer vanes 28, fins 29 and media will quickly abrade.

Moreover, when the space between the fins 29 and the stirrer vanes 28 becomes over 15 times the diameter of media to be used, media 17 stirred by the rotation of the stirrer vanes 28 pass through the space between the above fins 29 and the stirrer vanes 28 to easily, without receiving resistance by the fins 29, consequently, the shearing power produced in the above space will become weak.

The action of the dispersing apparatus 1 according to the present invention structured as mentioned above is described hereinafter. In a status where the vessel 2 is lifted by the operation of a lift provided on the body of the dispersing apparatus, the tank 8 filled with a compound 19 as an object of dispersion is provided under the above vessel 2, and the lift is operated so as to lower the vessel 2 at its lifted position and submerge the vessel 2 into the tank 8.

In the status where the vessel 2 is submerged in the compound as mentioned above, the stirrer shaft 3 and the hollow shaft 4 are rotated in mutually reverse directions by the driving force of motors M1 and M2.

In this embodiment, as an example, a 11 kw(s) motor as the above stirrer shaft motor M1, and a 7.5 kw(s) motor as the hollow shaft motor M2 provided on the vessel 2 are employed, and by inverter control, the stirrer shaft motor M1 is adjusted in the range from 120 to 1200 rpm, while the hollow shaft motor M2 is adjusted in the range from 60 to 600 rpm, and these motors are rotated in mutually reverse directions, whereby stirring media charged in the vessel 2.

By rotating the stirrer shaft 3 and the hollow shaft 4 in mutually reverse directions as mentioned above, the relative rotation speed of the stirrer vanes 28 in the vessel 2 increases, therefore increased shearing power can be attained in comparison with the case where only the stirrer vanes 28 are rotated to stir media.

When the stirrer vanes 28 provided at the lower end of the stirrer shaft 3 are made into plates, the contact area between the above stirrer vanes 28 and media is increased. The shearing power generated for stirring the media is increased by the vessel 2 rotating along with the rotation of the hollow shaft 4 in the direction opposite to the rotation direction of the stirrer shaft 3 and employment of plate-shaped fins 29 protruding from the inner wall of the vessel 2 in the inner peripheral direction. Accordingly, it is possible to disperse particles in a compound in a relatively short time by use of the dispersing apparatus according to the present invention.

Moreover, because the vessel 2 rotates in the compound within the tank 8, the compound in the tank 8 is flowing toward the rotation direction of the above vessel 2, thereby preventing the compound from piling up in the inside of the tank 8, especially in the lower portion of the tank 8.

In the case where vanes for flowing fluid 9 are attached to the bottom surface of the bottom plate 22 of the vessel 2, it is possible to create a flow of the compound 19 in the tank 8 by the rotation of the vessel 2 even more precisely. It is also possible to generate a flow of the compound under the vessel 2 which had been difficult by the known dispersing apparatus described in the prior art. As a consequence, it is possible to disperse the compound 19 uniformly, and to prevent unevenness in the dispersed conditions in the compound.

As mentioned above, where the vessel 2 is submerged in the compound, and when the stirrer shaft 3 is rotated with the hollow shaft 4, media in the vessel 2 are stirred by the stirrer vanes 28 provided on the stirrer shaft 3 and the fins 29 provided on the inner wall of the vessel 2 as mentioned previously, so as to collide and rub media with one another. Particles in the compound are therefore mashed finely and dispersed by the rubbing stress and the shearing power at this moment, and then discharged outside of the vessel 2 through the holes 7 formed in the cylindrical body 21 configuring the side wall of the vessel 2.

For ingress of the compound 19 a guide inlet 24 is formed on the top plate 23 of the vessel 2, for guiding the compound in the tank 8, and the above guide inlet 24 is secured via the flow route 34 formed between the stirrer shaft 3 and the hollow shaft 4, and the opening 43 formed in the hollow shaft 4 to the inside of the tank 8. Therefore, the compound in the tank 8 is always and continuously guided from the above opening 43, through the flow route 34 and the guide inlet 24 of the top plate 23 and into the vessel 2. Further, in the case where the vanes for flowing fluid 9 are attached to the bottom surface of the bottom plate 22 of the vessel 2, it is possible to make the compound under the vessel 2 flow sufficiently by force from the vanes for flowing fluid 9 that rotate together with the rotation of the vessel 2. This has been difficult to achieve by the conventional dispersing apparatus. Consequently, it is possible to preferably guide the compound from the opening 43 of the hollow shaft 4, through the flow route 34 and the guide inlet 24 of the top plate 23 into the inside of the vessel 2.

Further, the vessel 2 may be elevated in the tank 8 by operation of the above lift in dispersing the compound in the tank 8. In this case, the compound in the tank is stirred also by the elevation movement of the vessel 2, by which it is possible to prevent unevenness in dispersion.

In this manner, in the status where the vessel 2 is submerged in the compound in the tank 8, the stirrer shaft 3 and the hollow shaft 4 are rotated to disperse the compound for a specified time. Lumps of particles in the compound are finely mashed and dispersed by the media stirred in the vessel 2, and the dispersing process is completed.

At completion of the dispersion process as described above, the vessel 2 is lifted up by the lift operation, and the vessel 2 is pulled out from the inside of the tank 8 filled with the compound. The compound in the tank 8 after completion of dispersion is supplied to subsequent processing process on which the compound is processed into a desired product.

EFFECTS OF THE INVENTION

As mentioned heretofore, in the compound dispersing method and the dispersing apparatus according to the present invention, not only the stirrer vanes are rotated in the vessel, but also the vessel together with the above stirrer vanes are rotated in the direction reverse to the rotation direction of the above stirrer vanes so as to stir media contained in the vessel. This improves the shearing power by the media stirred in the vessel. Accordingly, it is possible to provide a dispersing apparatus whose dispersing performance has been further improved than those in the conventional dispersing apparatuses in the prior art.

Moreover, through the rotation of the vessel in the tank, it is possible to preferably flow and stir the compound in the tank and to preferably prevent particles in the compound from piling up at the bottom portion of the tank. Especially, in the case wherein vanes for flowing fluid are provided on the bottom surface of the above vessel, it is possible to stir the compound in the tank under the vessel. Consequently, it is possible to provide a dispersing apparatus enabling the compound in the tank to be evenly dispersed.

Furthermore, by making stirrer vanes plate-shaped, and arranging plate-shaped fins in the inner wall of the vessel for regulating the movement of media by the above stirrer vanes, and by creating force to move the media in the direction opposite to the movement direction of the media by the above stirrer vanes, it has been possible to provide a dispersing apparatus that can stir media charged in the vessel uniformly. Accordingly this enables the entire space in the vessel to be effectively utilized for dispersion, and to increase the shearing power produced by stirring media, thereby achieving a high dispersing efficiency, and consequently making it possible to perform quality constant dispersion with a smaller sized structure in comparison with the conventional dispersing apparatuses.

Thus, the claims that follow are not directed to a machine that is configured in a specific way. Instead, the claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall therebetween.

Now that the invention has been described;

What is claimed is:

1. A compound dispersing apparatus comprising:

a basket-shaped vessel, said vessel containing dispersing media particles in an interior cavity formed therein, said vessel submergible in a tank filled with a compound;

a plurality of plate shaped stirrer vanes housed within said vessel, each engaged at first ends with an elongated at first ends with an elongated shaft extending in said interior cavity, said shaft defining a central axis of said cavity;

each said stirrer vane extending a first distance from said axis to a distal edge;

means to rotate said shaft to thereby rotate said stirrer vanes in said interior cavity;

a plurality of plate shaped stirrer fins, each engaged at a first end with an interior wall of said vessel, each said stirrer fins extending from said first end toward said central axis, to a distal end;

each of said stirrer fins positioned in its engagement with said interior wall whereby said distal end reaches a momentary substantial alignment with a corresponding said distal edge of one of said stirrer vanes during each rotation of said shaft;

a gap_formed between said distal end and said distal edge during said momentary alignment, said gap defined by an empty space bordered on a first side by said distal end and on a second side a second distance from said first side, by said distal edge;

said gap providing means to increase a shear force of said dispersing media particles during said momentary alignment, and whereby said compound in said tank is drawn through said interior cavity and existed back to said tank by rotation of said vanes when said vessel is submerged in said tank.

2. The compound dispersing apparatus according to claim 1, wherein said means to rotate said shaft comprises:

said shaft having an exterior portion extending along said central axis, outside said vessel; and means to engage said means to rotate said shaft to said exterior portion.

3. The compound dispersing apparatus according to claim 2, wherein said means to rotate said shaft comprises:

means to rotate said vessel around said axis in a direction opposite said rotation of said shaft.

4. The compound dispersing apparatus according to claim 3, wherein said means to rotate said vessel comprises:

a second shaft engaging an upper portion of said vessel;

said second shaft having an axial passage extending therein along said central axis and adapted to accommodate rotation of said shaft therein;

means to rotate said shaft; and means to rotate said second shaft in a direction opposite that of said shaft.

5. The compound dispersing apparatus according to claim 4, further comprising:

secondary vanes engaged to an exterior surface of said vessel, whereby rotation of said vessel, rotates said secondary vanes around said central axis.

6. The compound dispersing apparatus according to claim 5, further comprising:

said secondary vanes engaged to a lower exterior surface of said vessel;

said lower exterior surface being on an opposite side of said vessel from said upper portion of said vessel; and whereby rotation of said vessel, rotates said secondary vanes around said central axis.

7. The compound dispersing apparatus according to claim 6 additionally comprising:

said dispersing media particles having a diameter; and said second distance being 6 to 15 times said diameter.

8. The compound dispersing apparatus according to claim 3, further comprising:

secondary vanes engaged to an exterior surface of said vessel, whereby rotation of said vessel, rotates said secondary vanes around said central axis.

9. The compound dispersing apparatus according to claim 1, wherein said means to rotate said shaft comprises:

means to rotate said vessel around said central axis in a direction opposite said rotation of said shaft.

10. The compound dispersing apparatus according to claim 9, further comprising:

secondary vanes engaged to an exterior surface of said vessel, whereby rotation of said vessel, rotates said secondary vanes around said central axis.

11. The compound dispersing apparatus according to claim 1 additionally comprising:

said dispersing media particles having a diameter; and said second distance being between 6 to 15 times said diameter.

* * * * *